US005295681A

United States Patent [19]

Blaser

[11] Patent Number: 5,295,681

[45] Date of Patent: Mar. 22, 1994

[54] AUXILIARY-PILE CARRIER FOR A LIFTING DEVICE FOR A PILE OF SHEETS

[75] Inventor: Peter T. Blaser, Dielheim, Fed. Rep. of Germany

[73] Assignee: Heidelberger Druckmaschinen AG, Heidelberg, Fed. Rep. of Germany

[21] Appl. No.: 42,999

[22] Filed: Apr. 5, 1993

[30] Foreign Application Priority Data

Apr. 4, 1992 [DE] Fed. Rep. of Germany ..... 4211353

[51] Int. Cl.[5] ..... B65H 1/30

[52] U.S. Cl. ..... 271/241; 271/159; 414/795.8

[58] Field of Search ..... 271/157, 158, 159, 218, 271/241; 414/795.8

[56] References Cited

U.S. PATENT DOCUMENTS

| | | | |
|---|---|---|---|
| 3,140,091 | 7/1964 | Reif et al. | 271/218 |
| 3,269,725 | 8/1966 | Schwebel | 271/159 |
| 3,960,374 | 6/1976 | Gaffney | 271/218 |
| 4,349,187 | 9/1982 | Weyrich | 271/159 |

FOREIGN PATENT DOCUMENTS

| | | | |
|---|---|---|---|
| 3028865 | 2/1982 | Fed. Rep. of Germany | 271/218 |
| 1059505 | 2/1967 | United Kingdom | 271/159 |
| 1196687 | 7/1970 | United Kingdom | 271/218 |

*Primary Examiner*—H. Grant Skaggs
*Attorney, Agent, or Firm*—Herbert L. Lerner; Laurence A. Greenberg

[57] ABSTRACT

An auxiliary-pile carrier in a pile lift of a sheet-processing machine is disclosed. The pile lift has a main-pile lifting unit and an auxiliary-pile lifting unit. The auxiliary pile is supported on a pile board having grooves formed in an upper surface thereof. The auxiliary pile carrier comprises auxiliary-pile carrier elements for carrying an auxiliary pile, the carrier elements each having a free end; forward cross-members for supporting the free end of each of the carrier elements; rear cross-members for supporting the carrier elements; the carrier elements are configured so as to allow a rod-like insertion thereof in the grooves formed in the upper surface of the pile board carrying the auxiliary pile, such that the carrier elements are aligned parallel to the grooves; the carrier elements are in the form of chains each having a plurality of links; the links are configured such that the chains are non-flexible in one direction beyond a substantially straight alignment of the links; the rear cross-member is a rotatable shaft with chain wheels rigidly disposed thereon; the chain wheels mesh with the chains and drive the chains.

19 Claims, 3 Drawing Sheets

AUXILIARY-PILE CARRIER FOR A LIFTING DEVICE FOR A PILE OF SHEETS

BACKGROUND OF THE INVENTION

Field of the Invention

The invention relates to an auxiliary-pile carrier for a lifting device for a pile of sheets with a main-pile lifting unit and an auxiliary-pile lifting unit in sheet-processing machines, particularly in sheet-fed printing presses, wherein auxiliary-pile-carrier elements are supported on a rear cross-member and are insertable in a rod-like manner into grooves of a pile board underneath an auxiliary pile and being aligned parallel to the grooves in a horizontal plane, wherein a forward cross-member is provided as a support for free ends of the inserted auxiliary-pile-carrier elements and wherein both cross-members are suspended from the auxiliary-pile lifting unit. The invention relates particularly to a pile changing device in the feeder of a sheet-fed rotary offset printing machine.

Auxiliary-pile carriers are known, mostly in the context of deliveries of sheet-fed printing machines. The prior art carriers are in the form of a rake. In order to effect a semi-automatic change of piles in non-stop operation, the sprockets of the rake are inserted into a gap between two sheets above the main pile counter to a transport direction of the sheets. In this way, an auxiliary pile is formed on the rake and the main pile can be changed. When in the inserted position, the rake rests on a forward and a rear cross-member of an auxiliary frame. The auxiliary frame is suspended by chains from an auxiliary-pile lifting unit. When the auxiliary pile is to be deposited on a pile board for a new main pile, the rake is withdrawn in the transport direction of the sheets and is stowed away in a location where it does not interfere with the operation of the printing press. Similar devices are also known in the art of pile feeders of sheet-fed rotary offset printing press.

A sheet feeder is known from German published patent application DE 39 31 710 for continuous-stream sheet feed in non-stop operation on an inclined feed table. An auxiliary-pile carrier is formed by non-stop rods, which are inserted in the sheet transport direction into grooves formed on the upper surface of a pile board. The non-stop rods are individually connected to the piston of a pneumatic cylinder. The pneumatic cylinder is disposed behind the pile and underneath the feed table with its axis parallel to the feed table in the feeder. In this way, the non-stop rods are inserted and retracted by the force of a motor.

Finally, very elaborate devices are known for the fully automatic changing of the feeder pile in machines with automatic sheet-pile feeding which operate according to different technical principles.

SUMMARY OF THE INVENTION

It is accordingly an object of the invention to provide an auxiliary-pile carrier for a lifting device for a pile of sheets, which overcomes the hereinafore-mentioned disadvantages of the heretofore-known devices of this general type and which allows simple construction of the initially mentioned kind and which makes the auxiliary-pile carrier suitable for use in a device for fully automatic pile changing in the feeder of a sheet-fed printing press.

With the foregoing and other objects in view there is provided, in accordance with the invention, an auxiliary-pile carrier in a pile lift of a sheet-processing machine having a main-pile lifting unit and an auxiliary-pile lifting unit and wherein an auxiliary pile is supported on a pile board having grooves formed in an upper surface thereof, comprising: auxiliary-pile carrier elements for carrying an auxiliary pile, the carrier elements each having a free end; forward cross-member support means for supporting the free end of each of the carrier elements; rear cross-member support means for supporting the carrier elements disposed apart from the rear cross-member; the carrier elements having means for allowing a rod-like insertion thereof in the grooves formed in the upper surface of the pile board carrying the auxiliary pile such that the carrier elements are aligned parallel to the grooves; the carrier elements being in the form of chains each having a plurality of links; the links including means for causing each of the chains to be non-flexible in one direction beyond a substantially straight alignment of the links; the rear cross-member being in the form of a rotatable shaft, and including chain wheels rigidly disposed on the shaft, the chain wheels meshing with the chains and driving the chains.

In the preferred embodiment of the auxiliary-pile carrier in the feeder of a sheet-fed printing press, the chains, provided in place of conventional non-stop rods, are guided from below over chain wheels on a shaft. As they leave the chain wheels, preferably through a guide member, the free ends of each of the chains faces towards a groove in the pile board underneath the sheet pile in the feeder. When the chain moves in under the pile of sheets, the chain links are supported by the bottom in the pile groove, until the free end of the chain comes to lie on the forward cross-member, disposed at the opposite side of the pile.

The chains are flexurally rigid in the direction of the loading by the auxiliary pile and they carry the auxiliary pile. At that point, the main pile can be lowered with the pile board and be replaced by another pile of sheets. The new pile is then raised in conventional manner to just below the auxiliary-pile carrier formed by the chains and then the chains can then be withdrawn from the pile.

In accordance with a further embodiment of the invention, frictional forces between the chains and the lowermost sheet of the auxiliary pile and between the chains and the uppermost sheet of the new main pile, may be reduced in that the chain links are coated with a material having low-friction properties. Where appropriate, the chains may include rollers or rolling members both on the undersides and also on the upper sides of the chain links.

In accordance with yet another feature of the invention, a movably disposed pile-push stop is provided at the level of the horizontal insertion plane of the chains on the side of the pile facing the shaft with the chain wheels. The auxiliary pile, and possibly also the main pile below, is used to push the pile from the chains as they are withdrawn and the two piles are united. It is advantageous for the pile-pushing stop to be adapted to be moved horizontally against the pile by means of a pneumatic cylinder and to be moved into a resting or stand-by position together with the pneumatic cylinder. In the resting position, the stop does not interfere with the merging of the main and auxiliary piles or with the changing of the main pile.

Preferred for purposes of the invention are one-sidedly flexurally rigid flat-link articulated chains. Such chains are known in principle.

In order to best align the chains with the grooves in the pile boards, the shaft with the chain wheels is axially displaceable. For that purpose it is connected to a sensor-controlled adjusting device. An accurate insertion of the chain ends into the grooves of the pile board is thus assured.

In accordance with a particularly advantageous feature of the invention, the shaft with the chain wheels over which the chains forming the auxiliary-pile carrier are guided, is driven with a motor. A control unit for the shaft drive motor can be integrated into a control system of an automatic pile-changing device in the feeder for non-stop operation when the pile is being changed.

Basically, an auxiliary-pile carrier comprising one-sidedly flexurally rigid chains as described above, is suitable also for auxiliary-pile formation in the delivery of a sheet-processing machine, particularly a sheet-fed rotary offset printing press. In such an embodiment, the chains should be flexurally rigid in a self-supporting manner, so that the chain ends projecting in self-supporting manner out of the guiding member do not bend in their link joints. This means that, in contrast to the application in the feeder of a lifting device for a pile of sheets, the one-sidedly flexurally rigid chains enter the guide member from above via the undersides of the chain wheels.

With objects of the invention in view, there is further provided, in accordance with another aspect of the invention, an auxiliary-pile carrier in an automatic pile-changing device of a sheet feeder of a sheet-fed rotary offset printing press including a pile lift with a main-pile lifting unit and an auxiliary-pile lifting unit, an auxiliary pile being supported on a pile board having recesses formed in an upper surface thereof for allowing pile-carrier elements to be inserted below the auxiliary pile. The novel auxiliary-pile carrier, comprises auxiliary-pile carrier elements for carrying an auxiliary pile, the carrier elements each having a free end; forward cross-member support means for supporting the free end of each of the carrier elements and rear cross-member support means for supporting the carrier elements; the carrier elements having means for allowing a rod-like insertion thereof in the grooves formed in the upper surface of the pile board carrying the auxiliary pile such that the carrier elements are essentially immersed in the grooves; the carrier elements being in the form of chains each having a plurality of links including means for causing each of the chains to be non-flexible in one direction beyond a substantially straight alignment of the links; the rear cross-member being in the form of a rotatable shaft, and including chain wheels disposed on the shaft, the chain wheels meshing with the chains and driving the chains.

Other features which are considered as characteristic for the invention are set forth in the appended claims.

Although the invention is illustrated and described herein as embodied in an auxiliary-pile carrier for a lifting device for a pile of sheets, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
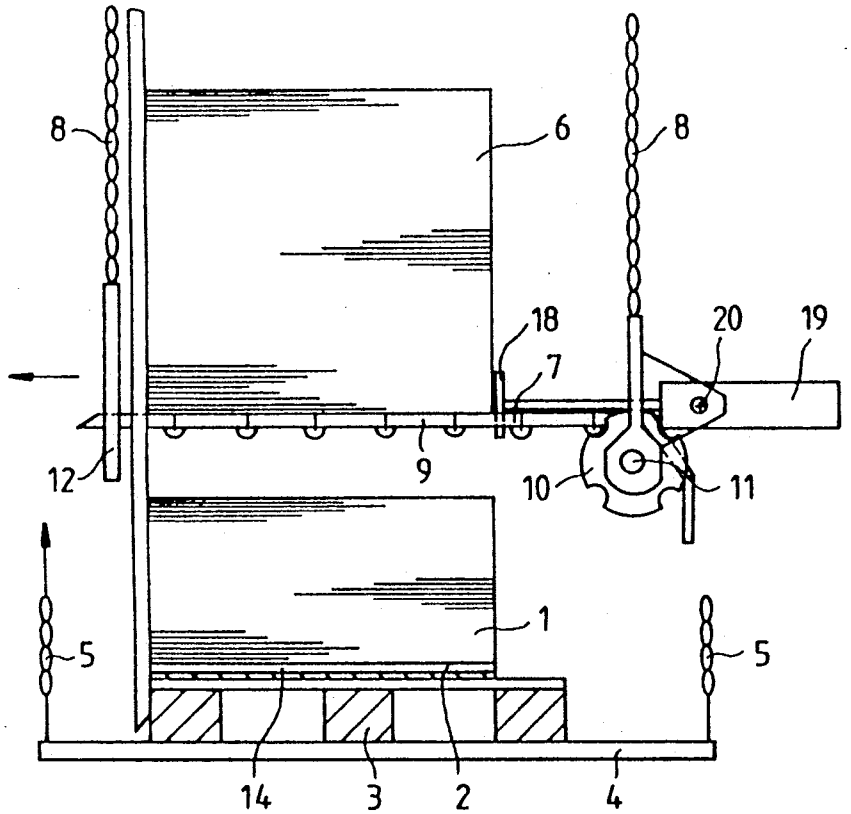
FIG. 1 is a diagrammatic, side-elevational view of a sheet feeder with an auxiliary pile above a main pile.

Referring now to the figures of the drawing in detail and first, particularly, to FIG. 1 thereof, there is seen a main stack or pile 1 deposited on a pile board 2, which is deposited on a pile pallet 3. The pile pallet 3 is situated on a pile table 4. The pile table 4 is suspended on chains 5 from a non-illustrated main-pile lifting unit in the feeder. An auxiliary stack or pile 6 is suspended above the main pile 1 by means of an auxiliary-pile carrier 7. The auxiliary-pile carrier 7 is connected to a non-illustrated auxiliary-pile lifting unit in the feeder by means of lifting chains 8. The lifting units are not illustrated because they are not essential to the understanding of the invention.

The carrier elements of the auxiliary-pile carrier 7 include a number of chains 9. Each chain 9 is one-sidedly flexurally rigid in a direction of gravitational force application by the auxiliary pile 6. The chains 9 are each guided over a chain wheel 10 on a transversely disposed shaft 11. The shaft 11 acts as a first cross-member of the auxiliary-pile carrier 7 and it is suspended from the auxiliary-pile lifting unit by the chains 8.

Opposite from the auxiliary pile 6, a second cross-member 12 is suspended from the auxiliary-pile lifting unit, likewise by means of chains. The cross-member 12 supports the free ends of the chains 9 pushed under the auxiliary pile 6.

Figure 2:
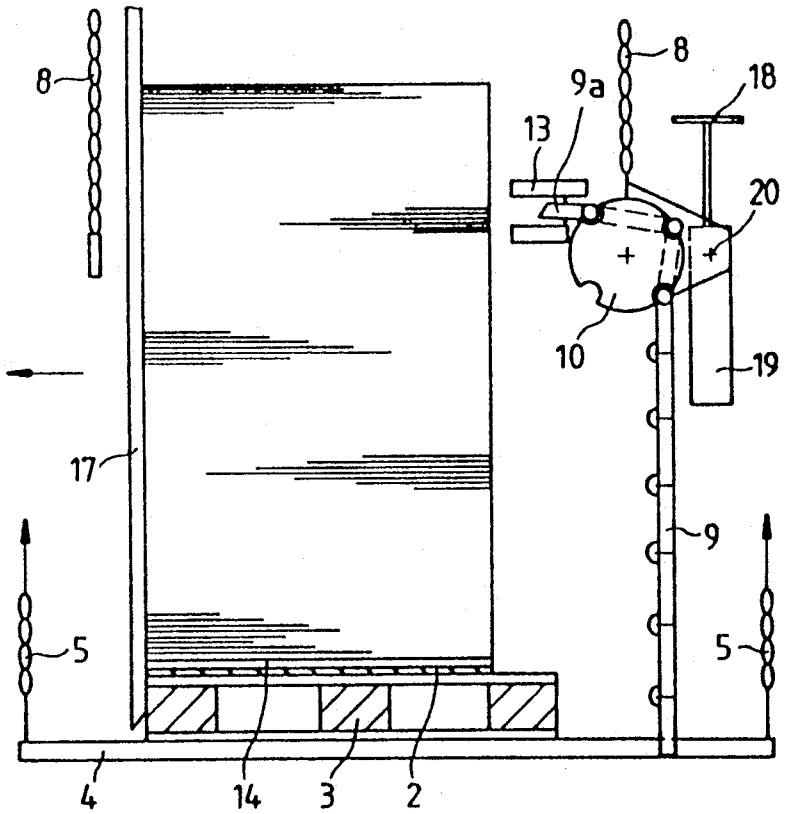
FIG. 2 is a similar view as that of FIG. 1, showing a feeder pile and the auxiliary-pile carrier in the rest position.
Figure 3:
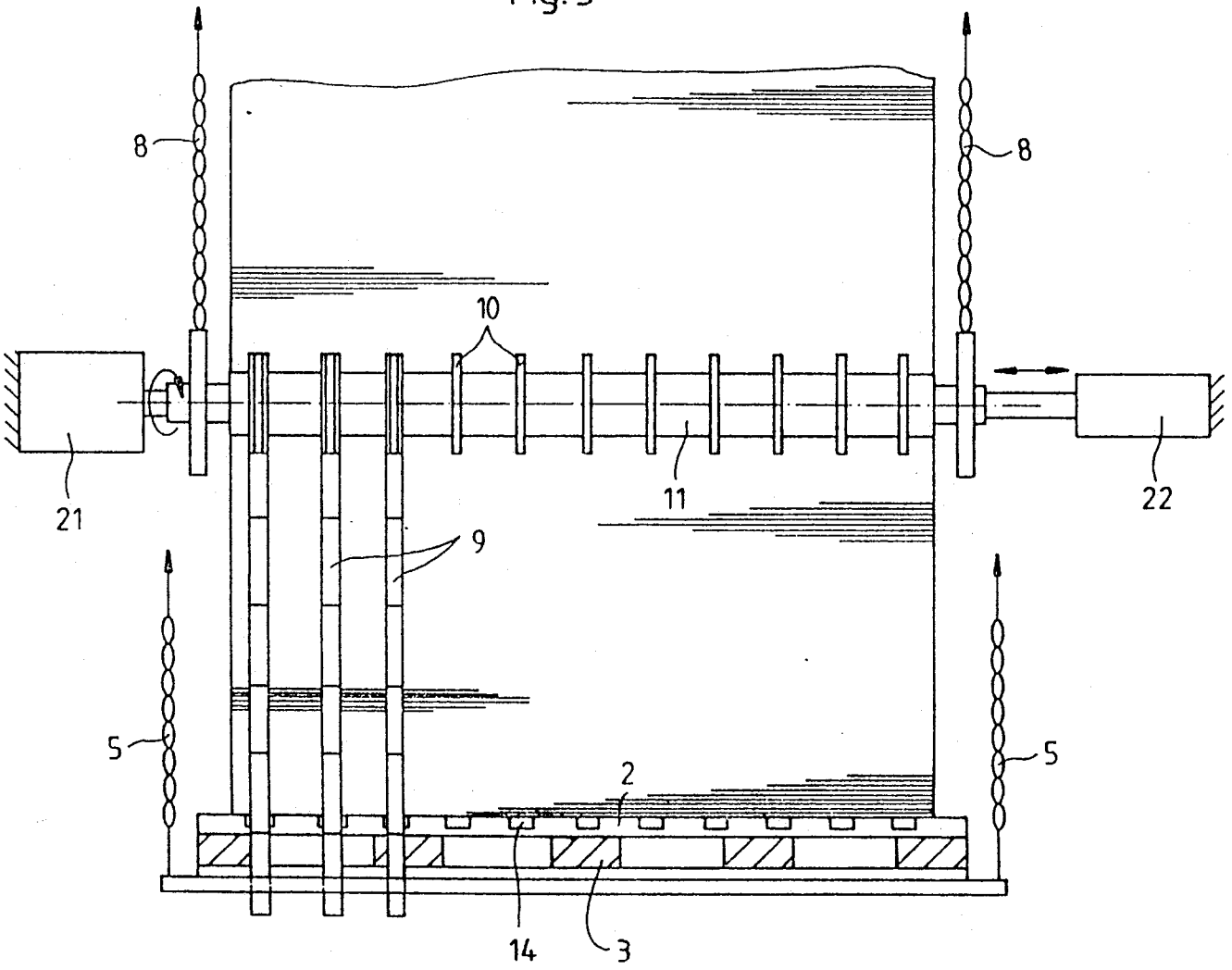
FIG. 3 is a rear-elevational view of the auxiliary-pile carrier in the rest position, as seen in the transport direction of the sheets.

With reference to FIG. 3, a plurality of chains 9 are spaced apart parallel to one another and are each guided over a chain wheel 10 on the shaft 11. Again with reference to FIG. 2, each chain 9 is guided, on the path between the chain wheel 10 and the auxiliary pile 6, in a guiding member 13. with the result that a first chain link 9*a*, disposed at the free end of the chain 9, is threaded into a depression or groove 14, formed in the upper surface of the pile board 2 below the main pile 1 (FIGS. 1 and 2). Furthermore, the chain 9 is guided by lateral disks or pulleys laterally disposed on the chain wheel 10.

Figures 4, 5:
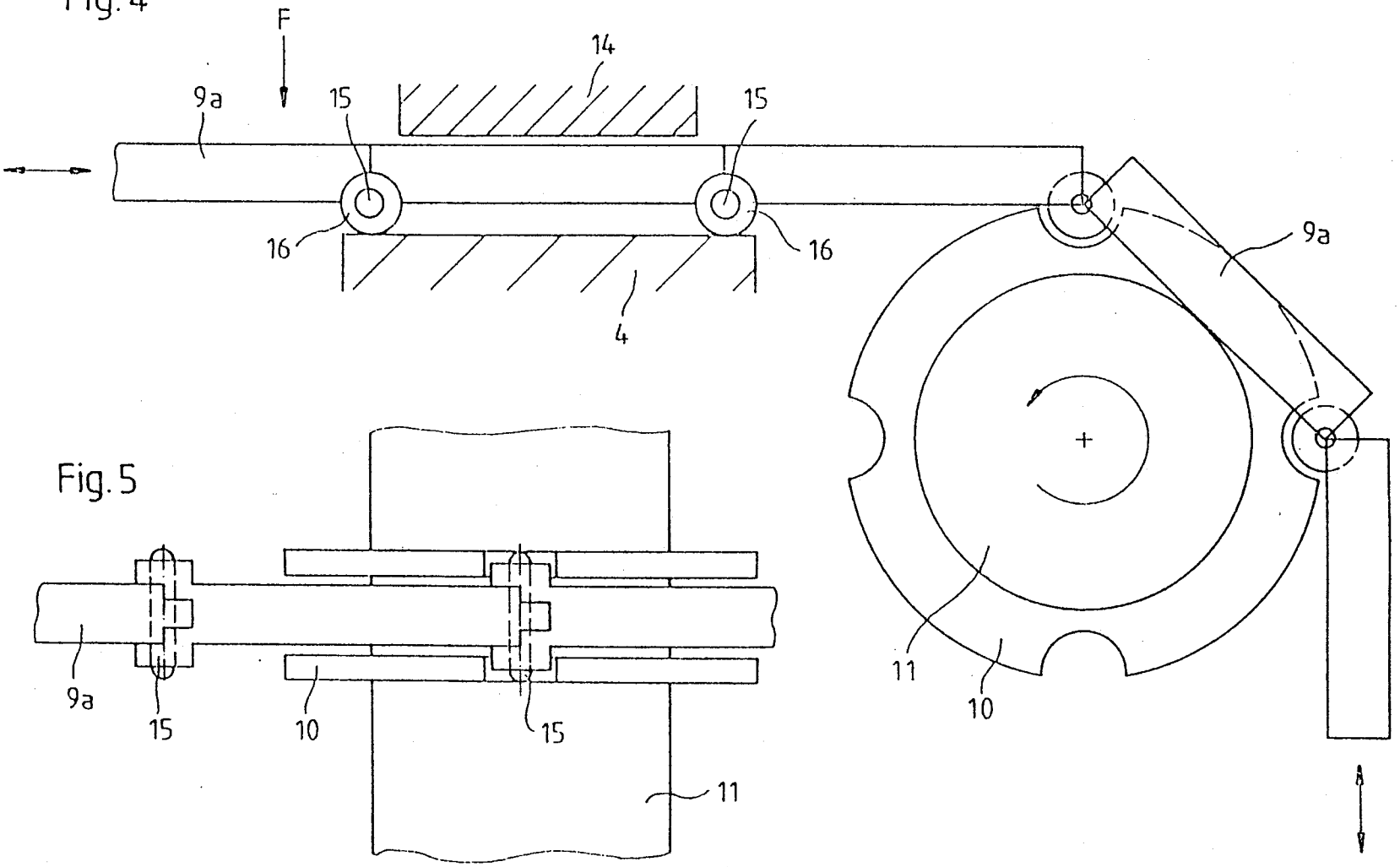
FIG. 4 is a partial side-elevational view, enlarged as compared to FIGS. 1-3, of a chain according to the invention in a guiding member.
FIG. 5 is a partial top-plan view of a chain and a chain wheel on the same scale as FIG. 4.

The exemplary embodiment has a steel side-bar chain or sprocket chain 9 comprised of individual chain links 9*a*. The chain (9) may also be referred to as a one-sidedly flexurally rigid flat-link chain 9 articulated about pivot joints 15. The pivot joints 15 of the chain 9 are each disposed on the underside. This means that, when the chain 9 is stretched as shown in FIGS. 4 and 5, end faces of the chain links 9a contact one another. The result is that the chain 9 is flexurally rigid in the vertical direction, i.e. in the negative z-direction in a conventional cartesian coordinate system. When the first chain member 9a at the free end of the chain 9 is supported in the cross-member 12 and a downward force is applied on the upper surface of the horizontally extended chain 9, it does not bend beyond the position shown in FIG. 1. In other words, the chain 9 supports the load of the auxiliary pile 6 when its free end is supported by the cross-member 12.

Any possible bending-through of the chain 9, i.e. an upwardly concave curved top surface of the chain under the expected weight of the auxiliary pile, may be counteracted by forming the chain 9 such that, in the unloaded condition, it assumes a slightly upwardly convex curved shape.

The joints 15 between the chain links 9a include rolling bodies or roller members 16, so that the chain 9 slides smoothly as it is being introduced into the groove 14 of the pile board 2. Furthermore, the chain links 9a may be coated with a material having low-friction properties, with the result that, after the piles 1 and 6 have been united, they may be withdrawn more easily.

In order to ensure that the auxiliary pile 6 and the main pile 1 do not retract from the front pile stop 17, a movably disposed pile shifter or pile-pushing stop 18, as for example a pile-pusher plate, is disposed at the level of the horizontal insertion plane of the adjacent chains 9 on the side of the pile facing the shaft 11 with the chain wheels 10. A pneumatic cylinder 19 presses the pile-pushing stop 18 against the lower end of the auxiliary pile 6 and, advantageously, also against the upper end of the main pile 1. In order to ensure that the pile-pushing stop 18 does not obstruct the uniting of the piles 1 and 6, it is adapted to be pivoted out of the operating position (FIG. 1) into a rest position (FIG. 2). Accordingly, the pneumatic cylinder 19, the pusher stop 18 and a connecting piston, may be pivoted about a horizontal axis 20.

An electric drive motor 21 is operatively connected to the shaft 11. Non-illustrated control elements for the drive motor 21 are integrated in a non-illustrated control system of the automatic pile-changing device for non-stop operation.

With reference to FIG. 3, the shaft 11 may be axially moved. A sensor-controlled adjusting device 22 shifts the shaft 11 axially and thus ensures that the chains are introduced accurately into the grooves 14 of the pile board 2. In other words, when the auxiliary pile is formed the forward links 9a of the chains 9 are correctly introduced into the grooves 14 of the pile board 2. Both the control elements of the motor 21 and the control elements of the adjusting device 22 may be integrated into the above-mentioned control system of the automatic pile-changer. In this way, non-stop operation may be implemented.

In view of the foregoing description it is seen that it is possible to provide the basic means for the fully automatic changing of the feeder pile in non-stop operation with relatively simple structural devices. Such fully automatic pile changing in non-stop operating mode of a printing press is especially desireable in the context of sheet-fed offset printing machines operating at high printing speeds.

I claim:

1. An auxiliary-pile carrier in a pile lift of a sheet-processing machine having a main-pile lifting unit and an auxiliary-pile lifting unit and wherein an auxiliary pile is supported on a pile board having grooves formed in an upper surface thereof, comprising:

auxiliary-pile carrier elements for carrying an auxiliary pile, said carrier elements each having a free end;

forward cross-member support means for supporting said free end of each of said carrier elements;

rear cross-member support means for supporting said carrier elements disposed apart from said forward cross-member;

said carrier elements having means for allowing a rod-like insertion thereof in the grooves formed in the upper surface of the pile board carrying the auxiliary pile such that said carrier elements are aligned parallel to the grooves;

said carrier elements being in the form of chains each having a plurality of links; said links including means for causing each of said chains to be non-flexible in one direction beyond a substantially straight alignment of said links;

said rear cross-member being in the form of a rotatable shaft, and including chain wheels rigidly disposed on said shaft, said chain wheels meshing with said chains and driving said chains.

2. The auxiliary-pile carrier according to claim 1, wherein said free end of each of said chains is formed by a front link, and including guide means for guiding said front link into a corresponding groove of the pile board.

3. The auxiliary-pile carrier according to claim 1, wherein said chains have a cross-section approximately adapted to a cross-section of the grooves formed in the upper surface of the pile board, such that said chains are disposed fully inside the grooves.

4. The auxiliary-pile carrier according to claim 1, including pile-pushing stop means disposed at said rear cross-member support means for stopping the auxiliary pile when said chains are withdrawn from below the auxiliary pile and for pushing the auxiliary pile from said chains.

5. The auxiliary-pile carrier according to claim 4, including a pneumatic cylinder operatively associated with said pile-pushing stop means for pushing said pile-pushing stop means horizontally against the auxiliary pile.

6. The auxiliary-pile carrier according to claim 5, including pivot means for pivoting said pile-pushing stop means and said pneumatic cylinder about a substantially horizontal axis into a rest position such that said pile-pushing stop means does not interfere in a merging of the auxiliary pile with a main pile.

7. The auxiliary-pile carrier according to claims 4, including means for moving said pile-pushing stop means into a rest position such that said pile-pushing stop means does not interfere in a merging of the auxiliary pile with a main pile.

8. The auxiliary-pile carrier according to claim 1, wherein each of said chains is a one-sidedly flexurally rigid flat-link chain.

9. The auxiliary-pile carrier according to claim 8, wherein said links of said chains are coated with a material with low-friction properties.

10. The auxiliary-pile carrier according to claim 1, wherein said links of said chains are coated with a material with low-friction properties.

11. The auxiliary-pile carrier according to claim 1, wherein said chains include roller members disposed among said links.

12. The auxiliary-pile carrier according to claim 1, wherein said roller members are disposed on a lower side of said chains as seen in a horizontal position of said chains extending between said forward and rear cross-member support means.

13. The auxiliary-pile carrier according to claim 1, including guide disks disposed laterally of said chain wheels for guiding said chains on said chain wheels.

14. The auxiliary-pile carrier according to claim 1, including means for moving said rotatable shaft in an axial direction thereof for allowing adjustably accurate insertion of said free ends of said chains into the grooves of the auxiliary-pile board, said moving means including a sensor-controlled adjusting device.

15. The auxiliary-pile carrier according to claim 1, including motor drive means for rotatably driving said shaft and said chain wheels.

16. The auxiliary-pile carrier according to claim 15, wherein said motor drive means include control elements integrated into a control system of an automatic pile-changing device for a non-stop operating mode.

17. The auxiliary-pile carrier according to claim 1, wherein said chains, in an elongated, substantially horizontal position, are slightly upwardly curved.

18. The auxiliary-pile carrier according to claim 1, including chains for suspending said forward and rear cross-members from the auxiliary-pile lifting unit;

19. In an automatic pile-changing device of a sheet feeder of a sheet-fed rotary offset printing machine including a pile lift with a main-pile lifting unit and an auxiliary-pile lifting unit, an auxiliary pile being supported on a pile board having recesses formed in an upper surface thereof for allowing pile-carrier elements to be inserted therein, an auxiliary-pile carrier, comprising:

auxiliary-pile carrier elements for carrying an auxiliary pile, said carrier elements -each having a free end;

rear cross-member support means for supporting said carrier elements;

said carrier elements having means for allowing a rod-like insertion thereof in the grooves formed in the upper surface of the pile board carrying the auxiliary pile such that said carrier elements are essentially immersed in the grooves;

said carrier elements being in the form of chains each having a plurality of links including means for causing each of said chains to be non-flexible in one direction beyond a substantially straight alignment of said links;

said rear cross-member being in the form of a rotatable shaft, and including chain wheels disposed on said shaft, said chain wheels meshing with said chains and driving said chains.

* * * * *